US005335954A

United States Patent [19]

Holub et al.

[11] Patent Number: 5,335,954

[45] Date of Patent: Aug. 9, 1994

[54] PROPANE BOTTLE CARRIER

[75] Inventors: Timothy M. Holub, Cheney; Regis Schulte; Robert Deines, both of Wichita, all of Kans.

[73] Assignee: The Coleman Company, Inc., Wichita, Kans.

[21] Appl. No.: 118,637

[22] Filed: Sep. 10, 1993

[51] Int. Cl.[5] ..... B65D 23/10

[52] U.S. Cl. ..... 294/31.2; 294/32; 215/100 A

[58] Field of Search ..... 294/27.1, 28, 29, 31.2, 294/32; 220/758, 759; 215/100 A; 248/145.6

[56] References Cited

U.S. PATENT DOCUMENTS

| | | | |
|---|---|---|---|
| 2,300,744 | 11/1942 | Jenkins | 294/31.2 X |
| 2,801,743 | 8/1957 | Geen | 220/759 X |
| 2,942,828 | 6/1960 | Kondrat | 248/145.6 |
| 2,958,444 | 11/1960 | Rhoe | 294/31.2 X |
| 3,202,309 | 8/1965 | Simpson | 294/32 X |
| 3,458,164 | 7/1969 | Massey | 248/145.6 |
| 3,719,305 | 3/1973 | Pressnell | 215/100 A X |
| 4,458,933 | 7/1984 | Thomas . | |
| 4,486,044 | 12/1984 | Gordon et al. . | |
| 4,666,197 | 5/1987 | Watson . | |

FOREIGN PATENT DOCUMENTS

| | | | |
|---|---|---|---|
| 313780 | 8/1969 | Sweden | 294/29 |
| 306328 | 6/1955 | Switzerland | 294/32 |
| 277569 | 9/1927 | United Kingdom | 215/100 A |

OTHER PUBLICATIONS

Coleman Drawing No. 5114G103 for base for propane cylinder (Mar. 18, 1992).

Photograph of Coleman base for propane cylinder.

*Primary Examiner*—Dean J. Kramer

[57] ABSTRACT

A propane bottle carrier is formed from three parts—a base, a handle, and a top ring. The base supports the bottom of a propane bottle. The ring is pivotally secured to the handle and is pivotable between an upwardly extending loading position in which the propane bottle can be inserted into the base and a holding position in which the top ring encircles the propane bottle.

6 Claims, 2 Drawing Sheets

PROPANE BOTTLE CARRIER

BACKGROUND

This invention relates to a propane bottle carrier, and, more particularly, to a propane bottle carrier which is formed from three interconnected molded plastic parts.

Propane is a commonly used fuel for lanterns, camp-stoves, soldering or brazing torches, etc. Propane fuel is usually contained in large, refillable tanks which hold about 20 pounds of fuel and small, disposable tanks or bottles, which hold 14 or 16 ounces of fuel. The 14 and 16 ounce tanks are called bottles even though they are fabricated from metal.

A conventional 14 ounce propane bottle is relatively long and narrow. The diameter of the bottle is about 3 inches, and the bottle can be easily gripped and carried by one hand.

A conventional 16 ounce propane bottle is wider, having a diameter of about 4 inches. It is difficult or awkward to carry a 16 ounce bottle in one hand.

Plumbers frequently use 16 ounce propane bottles for fueling torches for soldering or brazing joints. Plumbers have a particular need for a device which permits a 16 ounce propane bottle to be carried by one hand. However, such a carrying device could be used by anyone which uses 16 ounce propane bottles.

Although 14 ounce propane bottles can be gripped relatively easily, the long, narrow bottle is relatively unstable. A device which could be used not only to carry the bottle but to provide stability would be advantageous.

SUMMARY OF THE INVENTION

The invention provides an inexpensive, lightweight propane bottle carrier which enables the user to carry a bottle with one hand and which provides a stable support for the bottle. The carrier is formed from three injection molded plastic parts—a base, a handle, and a top ring. The bottom of the handle snap fits into the base, and the top ring is pivotally secured to the top of the handle. The propane bottle is supported by the base, and the top ring pivots over the top of the bottle to secure the bottle to the carrier. The base provides a stable support for the propane bottle when the bottle is not being carried.

DESCRIPTION OF THE DRAWING

The invention will be explained in conjunction with an illustrative embodiment shown in the accompanying drawing, in which—

DESCRIPTION OF SPECIFIC EMBODIMENT

Figure 1:
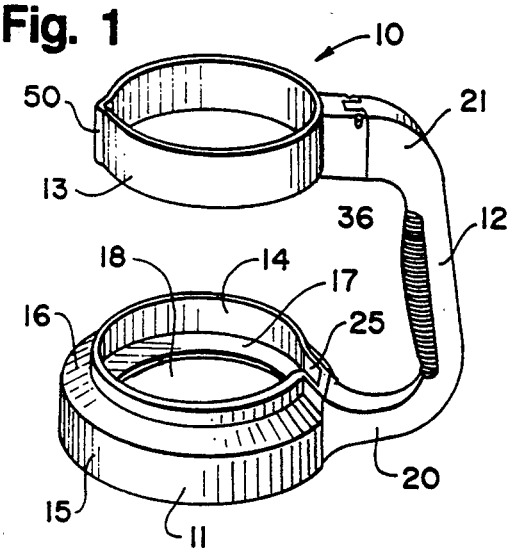
FIG. 1 is a perspective view of a propane bottle carrier formed in accordance with the invention.

The numeral 10 designates generally a propane bottle carrier which includes a base 11, a handle 12, and a top ring 13. The base 11 includes a cylindrical inner wall 14, a cylindrical outer wall 15 which is spaced outwardly from the inner wall, and a top wall 16 which curves upwardly from the outer wall to the inner wall. The inner wall terminates above the bottom edge of the outer wall, and an annular bottom wall 17 extends radially inwardly from the bottom of the inner wall. The bottom wall is provided with a central opening 18.

The handle 12 includes a lower end portion 20 which is attached to the base 11 and an upper end portion 21 which is pivotally connected to the top ring 13. A grip portion 22 in the middle of the handle is provided with a knurled surface 23.

Figure 3:
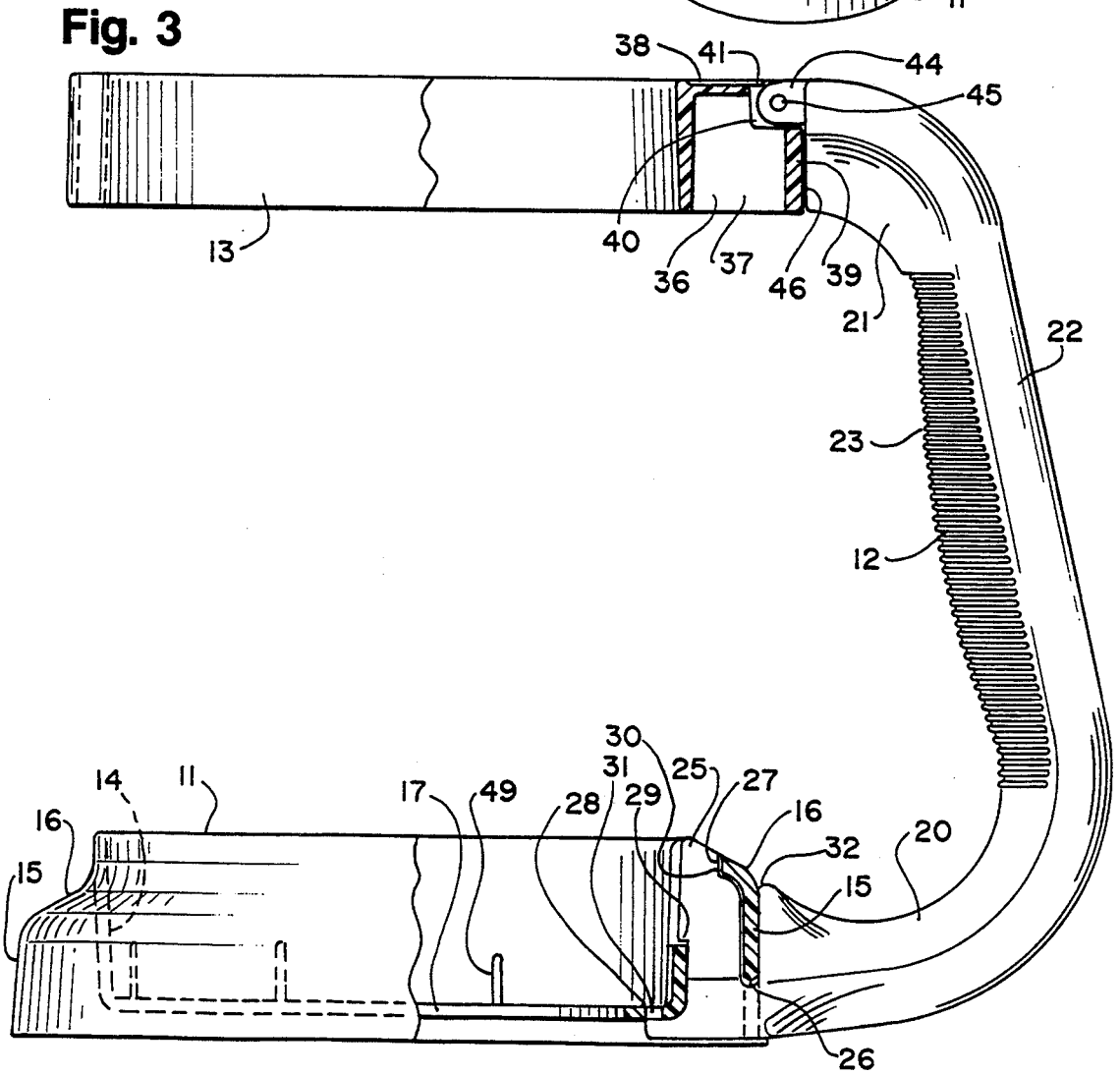
FIG. 3 is a side elevational view, partially broken away, of the propane bottle carrier.
Figure 4:
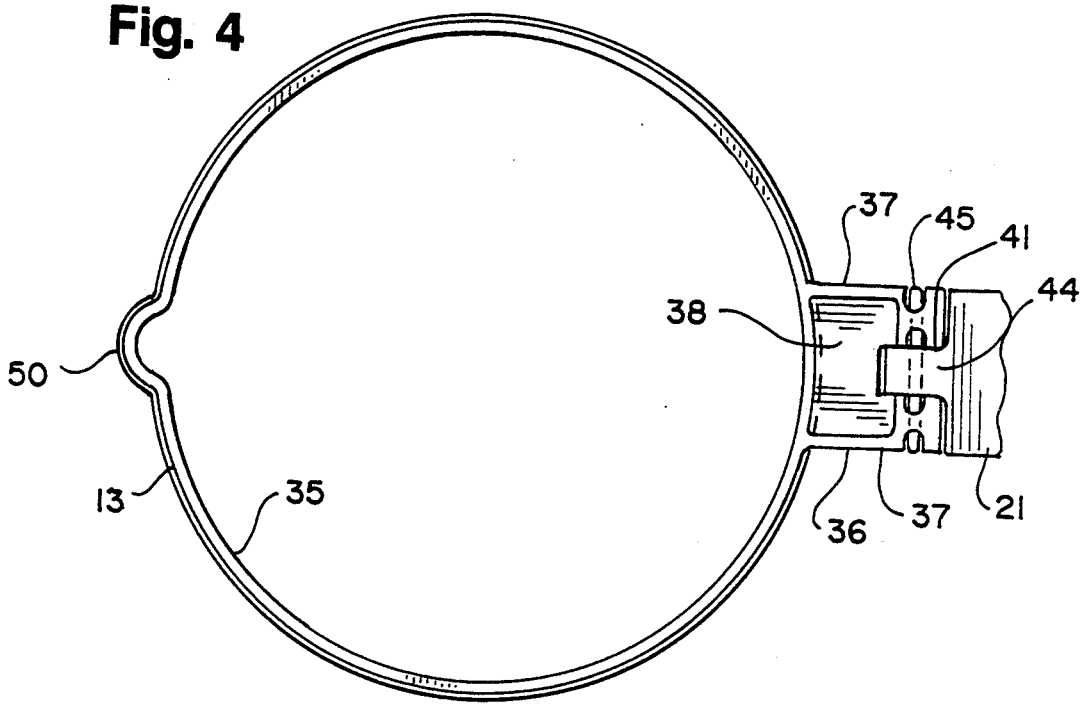
FIG. 4 is a fragmentary top plan view of the propane bottle carrier.
Figure 5:
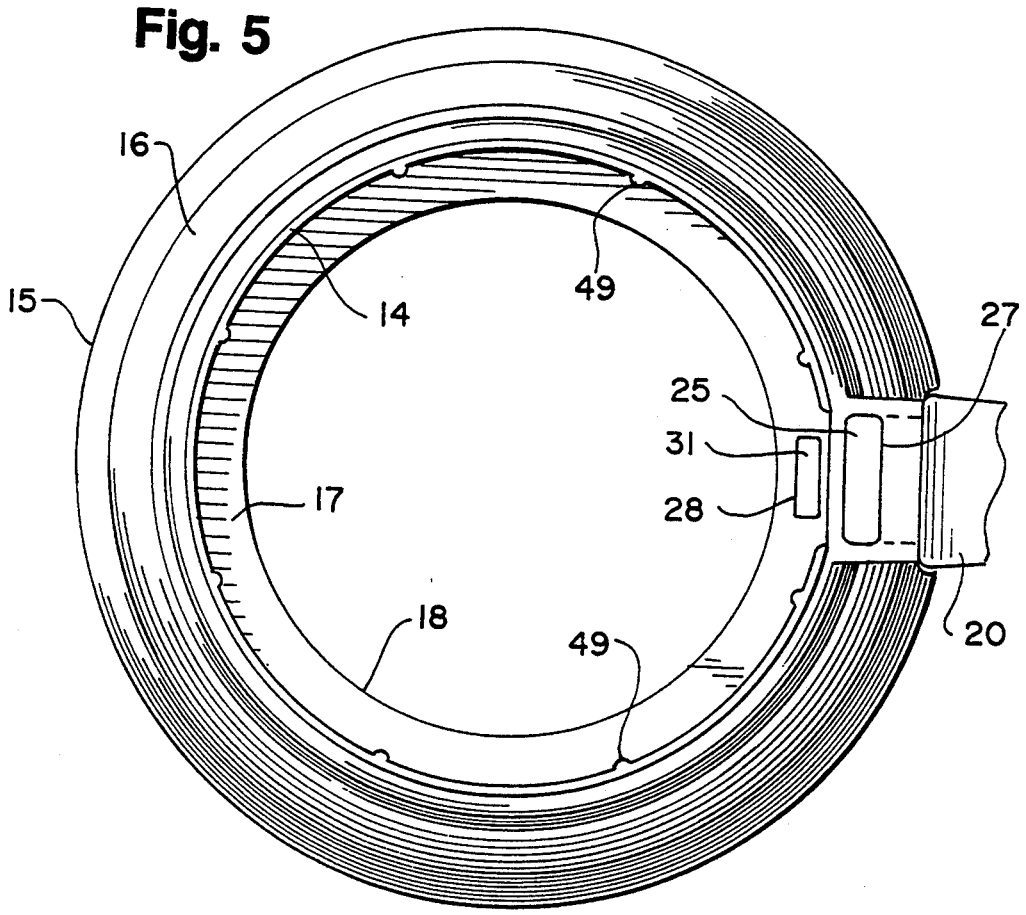
FIG. 5 is a fragmentary top plan view of the base of the propane bottle carrier.

Referring to FIG. 3, the bottom end portion 20 of the handle includes a projection 25 which is sized to be inserted between the inner and outer walls 14 and 15 of the base. The bottom of the outer wall is recessed at 26, an opening 27 is provided in the inner and top walls 14 and 16, and an opening 28 is provided in the bottom wall 17. The projection 25 of the handle includes a radially inwardly extending shoulder 29 which is engageable with the bottom edge of the opening 27 and an upwardly extending shoulder 30 which is engageable with the top edge of the opening 27. An upwardly extending tab 31 at the bottom of the projection 25 extends through the opening 28. A recess 32 between the projection 25 and the remainder of the bottom end portion of the handle accommodates the outer wall 15.

The handle is attached to the base by inserting the projection 25 into the space between the inner and outer walls and snapping the shoulders 29 and 30 into the opening 27 in the inner and top walls of the base. The shoulder 29 engages the bottom edge of the opening 27 and prevents counterclockwise rotation of the base relative to the handle, and the shoulder 30 engages the top edge of the opening 27 and prevents clockwise relative rotation. The tab 31 and the bottom of the recess 32 also stablize the handle relative to the base and provide support for the base when the bottle carrier is lifted.

The top ring 13 includes a cylindrical wall 35 and a box portion 36 for pivotally attaching the top ring to the handle. The box portion includes a pair of spaced-apart side walls 37, a top wall 38, and an outer wall 39. The top wall and outer wall are recessed at 40, and the sides of the recess 40 are formed by a pair of side walls 41.

The upper end portion 21 of the handle includes a projection 44 which is inserted into the recess 40. The projection 44 is pivotally secured to the top ring by a pivot pin 45 which extends through an opening in the projection and openings in the parallel side walls 37 and 41.

The upper end portion of the handle includes a flat surface 46 which extends in a plane which is parallel to the axis of the central opening 18 of the base. The flat surface 46 abuts the flat outer wall 39 of the top ring and supports the top ring in cantilever fashion in a horizontal position in which the axes of the openings in the top ring and the base are aligned.

Figure 2:
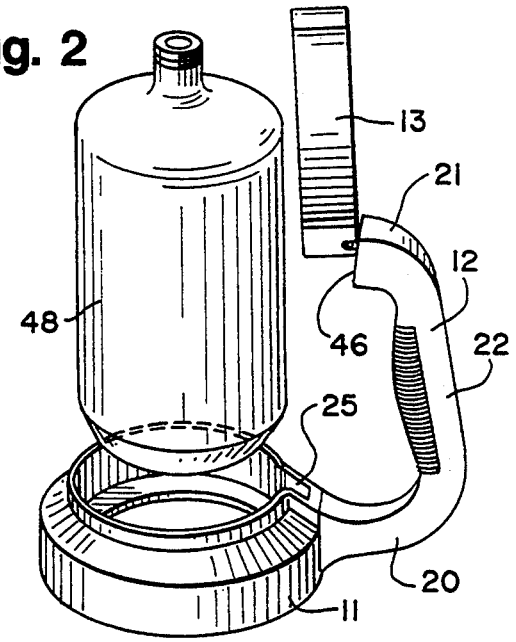
FIG. 2 is a perspective view showing a propane bottle being inserted into the carrier.

FIG. 2 illustrates a conventional 16 ounce propane bottle 49 being inserted into the base 11. However, it will be understood that a different sized propane carrier could be used with 14 ounce propane bottles. The top ring 13 is pivoted upwardly to the illustrated loading position to allow the bottle to be inserted. In the loading position the axis of the opening in the top ring extends generally perpendicularly to the axis of the opening in the base. The inside diameter of the inner wall 14 of the base is slightly larger than the diameter of the bottle. A plurality of ribs 49 (FIG. 3) are provided on the inner wall to provide a snug fit for the bottle. In one specific embodiment of a bottle carrier for a 16 ounce propane bottle, the inner wall was slightly conical and had an inside diameter of 3.910 inch at the top and an inside diameter of 3.830 inch at the bottom. The ribs 49 projected radially inwardly from the inner wall about 0.024 inch.

The bottom of the propane bottle is supported by the annular bottom wall 17 of the base. The top ring 13 is then pivoted downwardly over the top of the propane bottle and fits around the cylindrical side wall of the bottle. In one specific embodiment of a carrier for a 16 ounce propane bottle, the inside diameter of the cylindrical wall 35 of the top ring was 3.880 inch. The height of the handle, i.e., the dimension which extends parallel to the axes of the openings in the base and the top ring, was 6.465 inch. The top ring was thereby positioned to encircle the cylindrical side wall of the propane bottle below the dome-shaped top of the propane bottle. The portion of the top ring opposite the pivot pin includes a U-shaped projection 50 to facilitate pivoting the top ring upwardly.

The propane bottle can be carried with one hand by grasping the grip portion 22 of the handle 12. The propane bottle is held in a stable manner by the inner wall 14 of the base and the top ring 13, and the bottle can be carried with its axis extending horizontally without falling out of the bottle carrier.

The base 11 provides a stable support for the propane bottle when the bottle is not being carried and decreases the possibility that the bottle will be accidentally tipped over. In one specific embodiment of a 16 ounce bottle carrier, the outside diameter of the bottom of the outer wall 15 was 5.25 inches.

The base and top ring are advantageously injection molded from plastic, for example, polypropylene. The handle is advantageously injection molded from foamed plastic, for example, polypropylene with a blowing agent. The carrier is inexpensive, lightweight, and durable.

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. A fuel container carrier comprising:

an annular base having a cylindrical side wall which provides a central opening which is sized to receive the diameter of a cylindrical propane bottle and bottom support means extending radially inwardly from the side wall for supporting the bottom of the fuel container, a handle secured to the side wall of the base and extending upwardly therefrom, the handle including a grip portion which extends generally parallel to the axis of the opening int he base and a top end portion, a top ring pivotally secure to the top end portion of the handle, the top ring having a central opening which is sized to receive the diameter of a cylindrical fuel container and being pivotable between a holding position in which the axis of the opening in the top ring is aligned with the axis of the opening in the base and a loading position which permits a fuel container to be inserted into the base, the axis of the opening in the top ring int he loading position extending generally perpendicularly to the axis of the opening in the base, the top end of the handle including an abutment surface which extends in a plane which is generally parallel to the axis of the opening in the base, and the top ring including an abutment surface which is engageable with the abutment surface of the top end of the handle when the handle is in the holding position whereby the top ring is supported in a cantilever fashion.

2. The propane bottle carrier of claim 1 in which the top end of the handle includes a projection which extends generally perpendicularly to the grip portion and which is received in a recess in the top ring, and a pivot pin which extends through the top ring in the projection.

3. The propane bottle carrier of claim 1 including a pivot pin which pivotally connects the top ring and the top end of the handle, said abutment surfaces of the top ring and the top end of the handle being positioned between the pivot pin and the base.

4. A fuel container carrier comprising:

an annular base having a cylindrical side wall which provides a central opening which is sized to receive the diameter of a cylindrical propane bottle and bottom support means extending radially inwardly from the side wall for supporting the bottom of the fuel container, a handle secured to the side wall of the base and extending upwardly therefrom, the handle including a grip portion which extends generally parallel to the axis of the opening in the base and a top end portion, a top ring pivotally secured to the top end portion of the handle, the top ring having a central opening which is sized to receive the diameter of a cylindrical fuel container and being pivotable between a holding position in which the axis of the opening in the top ring is aligned with the axis of the opening in the base and a loading position which permits a fuel container to be inserted into the base, the base including an outer cylindrical wall which surrounds said first-mentioned cylindrical side wall and is spaced therefrom and a top wall which connects the outer wall and the first side wall, the handle including a bottom end portion having an upwardly extending projection which is sized to fit into the space between the outer wall and the first side wall.

5. A fuel container carrier comprising:

an annular base having a cylindrical side wall which provides a central opening which is sized to receive the diameter of a cylindrical propane bottle and bottom support means extending radially inwardly from the side wall for supporting the bottom of the fuel container, a handle secured to the side wall of the base and extending upwardly therefrom, the handle including a grip portion which extends generally parallel to the axis of the opening in the base and a top end portion, a top ring pivotally secured to the top end portion of the handle, the top ring having a central opening which is sized to receive the diameter of a cylindrical fuel container and being pivotable between a holding position in which the axis of the opening in the top ring is aligned with the axis of the opening in the base and a loading position which permits a fuel container to be inserted into the base, the base including an outer cylindrical wall which surrounds said first-mentioned cylindrical side wall and is spaced therefrom and a top wall which connects the outer wall and the first side wall, the handle including a bottom end portion which is inserted into the space between the outer wall and the first side wall, the bottom end portion of the handle including a first radially inwardly extending shoulder which extends through an opening in the first side wall and which is engageable with the first side wall to prevent rotation of the handle relative to the base in a first direction and a second shoulder which extends through an opening in the top wall and which is engageable with the top wall to prevent rotation of the handle relative to the base in a second direction.

6. The propane bottle carrier of claim 5 in which the bottom end portion of the handle includes a third projection which extends through an opening in the bottom support means of the base.

* * * * *

UNITED STATES PATENT AND TRADEMARK OFFICE

CERTIFICATE OF CORRECTION

PATENT NO. : 5,335,954

DATED : August 9, 1994

INVENTOR(S) : Timothy M. Holub et al

It is certified that error appears in the above-indentified patent and that said Letters Patent is hereby corrected as shown below:

Col. 3, line 58 change "int he" to --in the-- and in line 60 change "secure" to --secured--, and in line 68 change "int he" to --in the--.

Signed and Sealed this

Twentieth Day of December, 1994

*Attest:*

Bruce Lehman

BRUCE LEHMAN

*Attesting Officer*

*Commissioner of Patents and Trademarks*